US007207901B2

(12) United States Patent
Sano et al.

(10) Patent No.: US 7,207,901 B2
(45) Date of Patent: Apr. 24, 2007

(54) GOLF CLUB HEAD

(75) Inventors: Yoshinori Sano, Kobe (JP); Yoshikazu Yabuki, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

(21) Appl. No.: 10/417,156

(22) Filed: Apr. 17, 2003

(65) Prior Publication Data

US 2003/0203766 A1 Oct. 30, 2003

(30) Foreign Application Priority Data

Apr. 19, 2002 (JP) ..... 2002-118095

(51) Int. Cl.
*A63B 53/04* (2006.01)

(52) U.S. Cl. ..... 473/349

(58) Field of Classification Search ..... 473/324–350
See application file for complete search history.

(56) References Cited

U.S. PATENT DOCUMENTS 5,534,577 A * 7/1996 Namba et al. ..... 524/377
5,743,812 A * 4/1998 Card ..... 473/327
5,863,646 A * 1/1999 Verardi et al. ..... 428/323
2002/0183133 A1* 12/2002 Sano ..... 473/324
2003/0032497 A1* 2/2003 Sano ..... 473/324

FOREIGN PATENT DOCUMENTS

JP 11-235405 A 8/1999
JP 2003-38688 A * 2/2003

OTHER PUBLICATIONS

Callister, Jr., William D., Materials Science and Engineering: An intrduction 4th Edition. New York: John Wiley & Sons, Inc., copyright 1997.,p. 489.*

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head comprises a main body and a coating film covering a metallic surface of the main body, wherein the coating film comprises a clear foundation layer formed on the metallic surface and containing acid-modified polyolefin based resin as its base resin, and a colored clear second layer formed outside the foundation layer so that said metallic surface is visible through the coating film.

9 Claims, 2 Drawing Sheets

GOLF CLUB HEAD

This nonprovisional application claims priority under 35 U.S.C. § 119(a) on Patent Application No(s). 2002-118095 filed in JAPAN on Apr. 19, 2002, which is (are) herein incorporated by reference.

BACKGROUND OF THE INVENTION

The present invention relates to a golf club head, more particularly to a coating film improved in weathering resistance, adhesion strength, and beauty of the coated surface.

In the golf clubs, everlasting requirements are improved performance, e.g. carry, directional stability, directional controllability, rebound performance and the like.

In recent years, in addition to such performance requirements, there is a great demand for club heads improved in aesthetic qualities such as beauty, design and high-quality finish in the appearance. Such demand is especially strong in the metal wood-type golf club heads. The metal wood-type golf club heads are, on the other hand, remarkably increased in the size, and the head volume reaches to over 400 cc in recent years.

Conventionally, the surface of such a big size head is coated with a primarily coat formed by a colored paint including pigment as its colorant (thus, opaque) and an outer coat formed by a clear and colorless paint. In such large sized heads, however, the users very likely get a heavy impression therefrom. Such impression is a potential minus factor in golf competitions.

SUMMARY OF THE INVENTION

Therefore, a primary object of the present invention is to provide a golf club head capable of giving a light impression to the user even if the club head is large sized and also capable of improving the beauty of the coated surface.

The inventors found that it becomes possible to give a light impression to the user by forming a transparent coating film on a metallic surface of the club head so that the user can look or feel the surface through the coating film. However, if an epoxy resin which is conventionally widely used, is used to make the transparent coating film, since ultraviolet rays are easily able to reach to the interface, not only the coating film turns yellow, but also the coating film strength and adhesion strength is liable to decrease. Thus, the appearance of the club head degrades relatively fast, and there is a possibility of peel-off of the film as the adhesion strength decreases during use.

Therefore, a further object of the present invention is to provide a golf club head, in which the coating film is improved in weathering resistance and strength and capable of maintaining the improved beauty of the coated surface.

According to the present invention, a golf club head comprises a main body and a coating film covering a metallic surface of the main body, wherein the coating film comprises a clear foundation layer formed on the metallic surface and made of an acid-modified polyolefin based resin, and a colored clear layer formed outside the foundation layer, so that the metallic surface is visible through the coating film.

Therefore, the golf club user can feel the thickness of the coating film exaggeratedly to give a light weight impression to the user. Besides, the coating paint which contains an acid-modified polyolefin based resin as its base resin has excellent adhesion strength to a metallic surface and excellent weathering resistance, namely, yellowing and degradation by exposure to ultraviolet light can be avoided. Accordingly, the resultant coating film is increased in the weathering resistance, and the improved appearance may be maintained over a long period of time.

DESCRIPTION OF THE PREFERRED EMBODIMENTS

Figure 1:
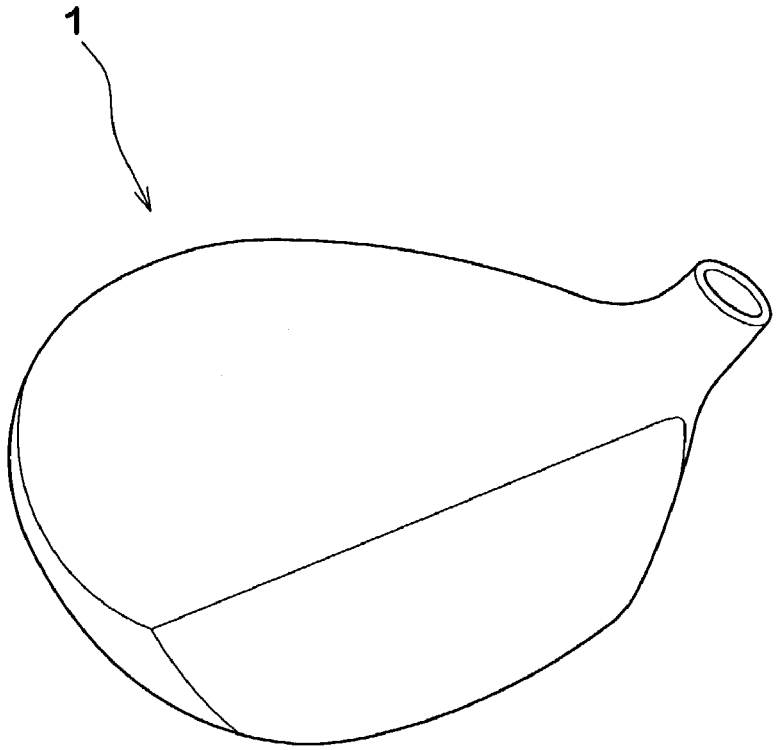
FIG. 1 is a perspective view of a wood-type golf club head according to the present invention.

Embodiments of the present invention will now be described in detail in conjunction with the accompanying drawings.

In the drawings, club head 1 according to the present invention comprises a main body 2 made of at least one kind of metal material, and a coating film 3 covering the major part of the metallic surface of the main body 2.

In this embodiment, the club head 1 is a wood-type club head. The coating film 3 covers the metallic surface excepting the sole (bottom face) of the club head. It is however, possible to determine the covered area according to need, for example, the front face (club face) may be excluded.

For the main body 2, metal materials whose strength per density is high such as titanium alloys are preferably used. However, other materials may be used.

In order to make the main body 2, two or more parts are first made through processes appropriate for the individual materials, such as casting (lost-wax precision casting), forging (cold, warm, hot) and press forming (bending, drawing etc.). The parts are assembled and firmly united using appropriate means such as welding, adhesive agent, caulking etc.

Then, the main body 2 is provided with the coating film 3 through the following coating processes including preparation of surface.

First, physical surface preparation or treatment is made on the metallic surface of the main body 2 to be coated. Specifically, the surface is polished by means of wire brushing, sand blasting or the like and then degreasing, cleaning and the like are made. If small dents or pinholes are found out, they should be closed with putty, adhesive agent or the like prior to the surface preparation/treatment.

Further, surface finish is optionally made as a separate process or an integrated process in the above-mentioned physical surface preparation. Here, the surface finish is meant for aesthetic purposes, such as mirror finish, satin finish and emboss finish. Incidentally, the mirror finish is to provide a specular surface for the main body 2 by polishing the metallic surface employing such as buff-polishing and barrel-polishing. The satin finish is to give a delustered metallic surface by sandblasting, wire brushing, sandpapering or the like with or without the simultaneous use of chemicals. The emboss finish is to provide a surface which is embossed with a certain pattern using a press die etc. In order to present a certain pattern on the metallic surface, various methods for example etching may be used in addition to embossing.

In the next place, a transparent and colorless foundation layer 3*a* is formed on the metallic surface of the main body 2 which has been surface-finished.

For the foundation layer 3A, a transparent and colorless paint containing an acid-modified polyolefin based resin as its base resin is used. When the paint is applied to the metallic surface of the main body 2, oxygen in the oxide film on the metallic surface and a hydroxyl group of the acid (carboxylic acid) of the acid-modified polyolefin resin make hydrogen bonding. Accordingly, its adhesion strength to the main body 2 is remarkably increased. Further, the decomposition and change of color by exposure to ultraviolet light which are occurred at a higher probability in epoxy resins can be effectively inhibited, and the foundation layer 3*a* becomes sun-proof.

For the acid-modified polyolefin based resin, for example graft copolymers wherein olefin resin is grafted onto an ethylene-based unsaturated carboxylic acid or its anhydride are used.

For the olefin resin, for example low-, middle- or high-density polyethylene; linear low-density polyethylene; homopolypropylene; crystalline propylene-ethylene copolymer; polybutene-1; polypentene-1; butene-1/propylene copolymer; butene-1/propylene/ethylene ternary copolymer; and the like may be used.

For the ethylene-based unsaturated carboxylic acid and anhydride, for example, acrylic acid, methacrylic acid, maleic acid, fumaric acid, crotonic acid, itaconic acid, citraconic acid, maleic anhydride, anhydrous citraconic acid, tetrahydro phthalic anhydride, and the like may be used. Especially, maleic acid is preferred.

Further, it is desirable to use the acid-modified polyolefin based resin which has a number average molecular weight in a range of from 10000 to 200000, more preferably 50000 to 200000, still more preferably 100000 to 160000.

If the number average molecular weight is less than 10000, the formation of the film becomes difficult. If the number average molecular weight is more than 200000, with resect to the viscosity, the paint becomes too thick and it becomes difficult to make the thickness of the coating film uniform.

Furthermore, it is preferable that the acid value of the acid-modified polyolefin based resin is set in the range of from 40 to 65, If the acid value is less than 40, the amount of carboxylic acid which hydrogen-bonds to the oxygen in the oxide film on the metallic surface decreases, and the adhesion strength to the main body 2 decreases. If the acid value is more than 65, the impact resistance of the coating film may be decreased as the hardness becomes excessively high.

Such primer paint which contains the acid-modified polyolefin based resin is applied to the main body 2 uniformly by using a spray gun, brush, etc. After the application of the primer paint, the applied paint is baked for about 15 to 20 minutes at a temperature of about 150 deg. C. to harden the coat, whereby a transparent and colorless primer coating, that is, the foundation layer 3*a* is formed on the surface of the main body 2. The foundation layer 3*a* also provides an advantageous effect to improve the adhesion of the undermentioned paint applied on the outside of the foundation layer 3*a*.

Here, the thickness of the foundation layer 3*a* is preferably set in the range of from 3 to 40 micrometers, more preferably 5 to 25 micrometers. If the thickness is less than 3 micrometers, it becomes difficult to make the coating surface smooth so the adhesion strength and appearance deteriorate. If the thickness is more than 40 micrometers, the adhesion strength and impact resistance tend to decrease Next, a colored clear layer 3*b* is formed on the foundation layer 3*a*, using a colored transparent paint.

The colored transparent paint contains a colorant and a base resin such as polyester resin and acrylic resin, but an epoxy resin is not included.

As to the colorant, in order to maintain the transparency, so-called dyestuffs such as synthetic dyestuff, vegetable dyestuff, animal dyestuff and mineral dyestuff are suitably used alone or in combination rather than so-called pigments because the dyestuffs have a very small particle diameter of about 1 to 2 nanometers when compared with the pigments. However, as far as the required degree of transparency can be furnished, it is not always necessary to use such dyestuffs. Other colorants may be used.

After the application of the colored transparent paint, the applied paint is baked for about 15 to 20 minutes at a temperature of about 150 deg. C. to harden the coat. Thus, the colored clear layer 3*b* is formed on the foundation layer 3*a*.

Here, if the colored clear layer 3*b* is too thin, it is difficult for the user to feel the thickness of the coating film. If too thick, the colored clear layer 3*b* becomes brittler and the impact resistance of the coating film decreases. Therefore, the thickness of the colored clear layer 3*b* is preferably set in the range of 10 to 50 micrometers, more preferably 20 to 40 micrometers.

In this embodiment, further, an iridescent layer 3*c* is formed on the colored clear layer 3*b* by applying an iridescent paint.

The iridescent paint contains iridescent materials 4 and a base resin such as polyester resin, polyurethane resin, acrylic resin or the like. In the iridescent paint too, an epoxy resin is not included. In this example, a colorant is also not included.

For the iridescent materials 4, for example, natural mica flakes, mica flakes coated with a titanium oxide or the like, metal flakes such as aluminum colored and/or coated with a resin may be used. Especially, aluminum flakes whose size is about 10 to 100 micrometers and which are colored by vapor deposition are preferably used because the desired color may be obtained readily and stably in comparison with natural materials.

In the hardened coating layer, a large part of the iridescent materials 4 are oriented such that surfaces of the flakes on one side thereof becomes substantially parallel with the surface of the coating layer. Accordingly, when viewed substantially perpendicular to the surface of the coating layer, the coating layer will present a particular color based on the color of the iridescent materials. However, when looked obliquely, the layer takes on another color as the percentage of the color of the iridescent materials 4 decreases while increasing the percentage of the color of the metallic surface of the club head main body. Thus, the orientation direction of the iridescent materials 4 may be changed according to the effect desired. Incidentally, in addition to the viewing angle change, such a change of color may be also caused by variation in the ambient light intensity. Therefore, the appearance becomes attractive due to the unpredictability of the color change and clear solid impression given to the user.

To maximize such effect, the quantity of the iridescent material 4 is preferably set in the range of about 0.1 to 7.5 weight %, more preferably 0.5 to 5.5 weight % based on that the total weight of the iridescent materials 4 and the base resin (excluding the solvent component) in the iridescent paint is 100%.

In this embodiment, the iridescent paint containing colored aluminum flakes and acrylic resin as its base resin is used.

After the application of the iridescent paint, the applied paint is baked for about 10 to 20 minutes at a temperature of about 150 degrees C. to form the iridescent layer 3*c* on the outside of the colored clear layer 3*b*.

If the iridescent layer 3*c* is too thin, it is difficult to achieve the iridescent color. If too thick, the impact resistance tends to decrease. Therefore, the thickness of the iridescent layer 3*c* is preferably set in a range of from 10 to 40 micrometers, more preferably 15 to 35 micrometers.

If the iridescent material 4 is too much or too less, the iridescent effect becomes insufficient. By setting the quantity of the iridescent materials 4 in the above-mentioned ranges, the degree of the transparency which varies according to the viewing angle and the maximum iridescent effect may be obtained.

In this embodiment, furthermore, from a point of view of protection for the iridescent layer 3*c*, a clear layer 3*d* is formed on the outside thereof as the fourth layer using a transparent and colorless clear paint.

In this clear paint, for example, polyester resin, polyurethane resin, acrylic resin or the like is preferably used as its base resin, but an epoxy resin is not included here again.

The overall thickness (t) of the coating film 3 which in this embodiment is made up of the four layers is preferably set in a range of not more than 100 micrometers, more preferably 25 to 90 micrometers, still more preferably 40 to 80 micrometers. If the overall thickness (t) is more than 100 micrometers, the impact resistance is liable to decrease.

As the coating film 3 is transparent excepting the iridescent materials therein, the user can look the curved surface of the main body 2 through the coating film 3, which may convey to the user an impression that the coating film 3 is thicker than the reality and the main body 2 is accordingly smaller, and thus the club head is lightweight. Further, the user can look or feel the finished surface with mirror-finish, satin-finish or the like through the coating film 3. Thus, it becomes possible to improve the club head in the appearance or in design.

Figure 2:
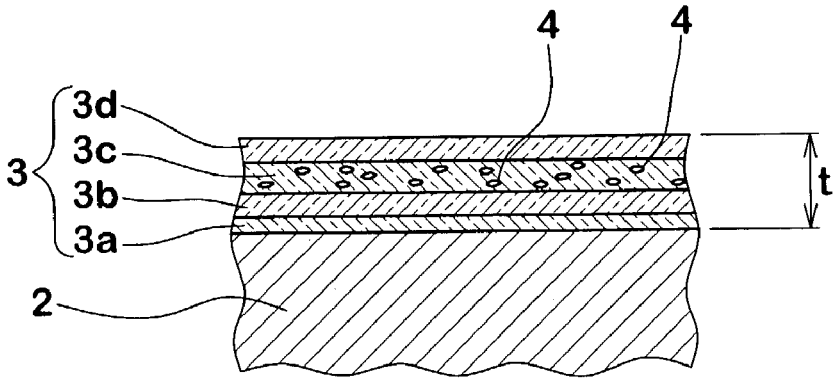
FIG. 2 is an enlarged cross sectional view of the coating film thereof.
Figure 3:
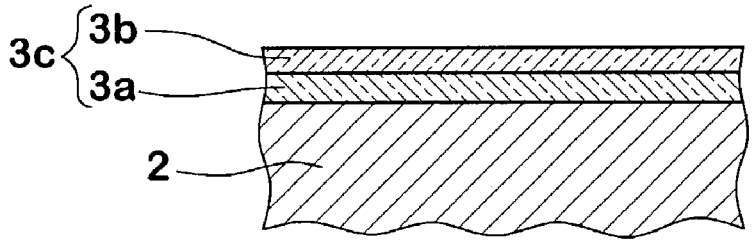
FIGS. 3 and 4 are enlarged cross sectional views each showing another example of the coating film.
Figure 4:
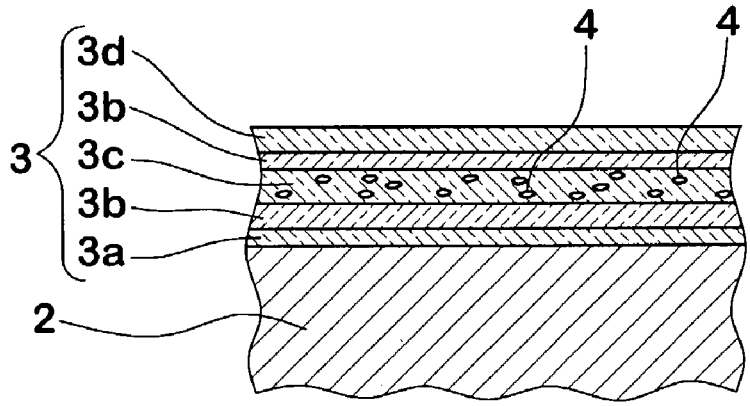

As to the layered structure of the coating film, aside from the four-layered structure illustrated in FIG. 2, a two-layered structure made up of the foundation layer 3*a* and colored clear layer 3*b* only as shown in FIG. 3 may be employed. Further, a structure of five or more layers, for example a modification from the illustrated four-layered structure wherein the colored clear layer 3*b* and/or iridescent layer 3*c* are formed in two or more layers (see FIG. 4), or wherein an additional clear layer which is colorless or has another color is formed between the foundation layer 3*a* and colored clear layer 3*b*.

Comparison Tests

Using identical main bodies, wood-type golf club heads were made changing the specifications of the coating film as shown in Table 1, and the coating films were tested for weathering resistance, impact resistance and adhesion strength. The surface to be coated of the club head main body was surface finished by satin polishing using #180 sandpaper. For the colored clear layer 3*b*, an amide based acrylate resin paint was used. The iridescent paint was an amide based acrylate resin paint (Aurora shine LC-190, DAI NIPPON TORYO CO.,LTD) in which colored aluminum flakes were mixed. The outermost clear layer was formed by using an amide based acrylate resin paint. Each of the paints was baked for 20 minutes at 150 degrees.

Impact Resistance Test:

An iron rod of 500 grams was dropped down onto the coating film from a height of 150 mm perpendicularly thereto, and the coating film was visually inspected for peel-off. The damage was evaluated into five ranks based on the size and depth. The larger the rank number, the higher the impact resistance.

Adhesion Strength Test:

The adhesion strength of the coating film was evaluated into five ranks in accordance with Crosshatch Test specified in the Japanese Industrial standard K5400 (1 mm×1 mm squares×100)

Rank: Number of peel-off per 100

5: 0

4: 1 to 5

3: 6 to 10

2: 11 to 20

1: over 20

Further, the adhesion strength was evaluated after the coating film was weathered using a device for creating an artificial environment, (sunshine Super Long Life weather Meter WEL-SUN-HC/B type, Suga Test Instruments Co., Ltd.). In the test chamber, the club head was weathered at a temperature of 63 degrees C. and a humidity of 50% for 120 hours including a rainfall condition for a period of 12 minutes per 60 minutes. Then, the above-mentioned adhesion strength test was performed.

Impression Test:

Ten golfers had a good look at the club heads and then the number of golfers who had a favorable impression from the aspect of design was counted for each head.

The number is indicated in Table 1 using the following signs.

x: 0 to 5 per ten golfers

○: 6 to 8 per ten golfers

◎: 9 to 10 per ten golfers

TABLE 1

| Club Head | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 | Ex. 15 | Ref. 1 | Ref. 2 | Ref. 3 | Ref. 4 |
|---|---|---|---|---|---|---|---|---|---|---|---|---|---|---|---|---|---|---|---|
| Foundation layer | Acid-modified polyolefin *1 | | | | | | | | | | | | | | | Epoxy | Polyurethan | Acrylic | Polyester |
| Base resin Thickness (μ) | 2 | 4 | 5 | 10 | 25 | 35 | 45 | 10 | 10 | 10 | 10 | 10 | 10 | 10 | 10 | 10 | 10 | 10 | 10 |
| Colored clear layer Thickness (μ) | 30 | 30 | 30 | 30 | 30 | 30 | 30 | 10 | 20 | 40 | 50 | 30 | 30 | 30 | 30 | 30 | 30 | 30 | 30 |

TABLE 1-continued

| Club Head | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 | Ex. 15 | Ref. 1 | Ref. 2 | Ref. 3 | Ref. 4 |
|---|---|---|---|---|---|---|---|---|---|---|---|---|---|---|---|---|---|---|---|
| Iridescent layer Thickness (μ) | 20 | 20 | 20 | 20 | 20 | 20 | 20 | 20 | 20 | 20 | 20 | 10 | 15 | 35 | 40 | 20 | 20 | 20 | 20 |
| Clear layer Thickness (μ) | 20 | 20 | 20 | 20 | 20 | 20 | 20 | 20 | 20 | 20 | 20 | 20 | 20 | 20 | 20 | 20 | 20 | 20 | 20 |
| Impact resistance | 4 | 5 | 5 | 5 | 5 | 4 | 3 | 4 | 5 | 5 | 3 | 5 | 5 | 5 | 3 | 3 | 4 | 3 | 3 |
| Adhesion strength | | | | | | | | | | | | | | | | | | | |
| before | 3 | 4 | 5 | 5 | 5 | 5 | 5 | 5 | 5 | 5 | 4 | 4 | 5 | 5 | 4 | 2 | 1 | 1 | 1 |
| after | 3 | 4 | 5 | 5 | 5 | 4 | 5 | 4 | 5 | 5 | 4 | 4 | 5 | 5 | 4 | 2 | 1 | 1 | 1 |
| Design impression | x | ○ | ◎ | ◎ | ◎ | ◎ | ◎ | ◎ | ◎ | ◎ | ○ | ○ | ◎ | ◎ | ○ | ◎ | ◎ | ◎ | ◎ |

(*1) PP Coat 7000P, DAI NIPPON TORYO CO., LTD.

From the test results, it was confirmed that the adhesion strength, weathering resistance can be improved without deteriorating the impact resistance.

The present invention is suitably applied to the wood-type golf club heads, especially which are of large size and globular, but it may be also applied to metal club heads of various types such as iron-type, utility-type and patter-type.

The invention claimed is:

1. A golf club head comprising a main body and a coating film covering a metallic surface of the main body, wherein the coating film comprises a clear foundation layer formed directly on the metallic surface and containing acid-modified polyolefin based resin as its base resin, and a colored clear second layer formed on the foundation layer, so that said metallic surface is visible through the coating film, wherein said acid-modified polyolefin based resin has an acid value of from 40 to 65, and said clear foundation layer is formed by applying a paint containing said acid-modified polyolefin based resin to the metallic surface and by baking the applied paint to harden, so that a hydroxyl group of an acid of the acid-modified polyolefin therein makes hydrogen bonding with oxygen in an oxide film on said metallic surface.

2. A golf club head comprising a main body, and a coating film covering a metallic surface of the main body, wherein the coating film comprises a clear foundation layer formed directly on the metallic surface and containing acid-modified polyolefin based resin as its base resin, and a colored clear second layer formed on the foundation layer, so that said metallic surface is visible through the coating film, and said metallic surface of the main body is mirror finished, wherein said acid-modified polyolefin based resin has an acid value of from 40 to 65, and said clear foundation layer is formed by applying a paint containing said acid-modified polyolefin based resin to the metallic surface and by baking the applied paint to harden, so that a hydroxyl group of an acid of the acid-modified polyolefin therein makes hydrogen bonding with oxygen in an oxide film on said metallic surface.

3. A golf club head comprising a main body, and a coating film covering a metallic surface of the main body, wherein the coating film comprises a clear foundation layer formed directly on the metallic surface and containing acid-modified polyolefin based resin as its base resin, and a colored clear second layer formed on the foundation layer, so that said metallic surface is visible through the coating film, and said metallic surface of the main body is satin finished, wherein said acid-modified polyolefin based resin has an acid value of from 40 to 65, and said clear foundation layer is formed by applying a paint containing said acid-modified polyolefin based resin to the metallic surface and by baking the applied paint to harden, so that a hydroxyl group of an acid of the acid-modified polyolefin therein makes hydrogen bonding with oxygen in an oxide film on said metallic surface.

4. The golf club head according to claim 1, 2 or 3, wherein the coating film further comprises an iridescent third layer on the colored clear second layer formed by coating with a transparent paint containing iridescent materials.

5. The golf club head according to claim 1, 2 or 3, wherein the coating film further comprises an iridescent third layer on the colored clear second layer formed by coating with a transparent paint containing iridescent materials, and a colorless clear fourth layer on the iridescent layer.

6. The golf club head according to claim 1, 2 or 3, wherein the acid-modified polyolefin based resin has a number average molecular weight in a range of from 10000 to 200000.

7. The golf club head according to claim 1, 2 or 3, wherein the acid-modified polyolefin based resin is a graft copolymer wherein olefin resin is grafted onto an ethylene-based unsaturated carboxylic acid or its anhydride.

8. The golf club head according to claim 7, wherein the olefin resin comprises one selected from a group consisting of low-density polyethylene; middle-density polyethylene; high-density polyethylene; linear low-density polyethylene; homopolypropylene; crystalline propylene-ethylene copolymer; polybutene-1; polypentene-1; butene-1/propylene copolymer; and butene-1/propylene/ethylene ternary copolymer.

9. The golf club head according to claim 8, wherein said ethylene-based unsaturated carboxylic acid or its anhydride comprises one selected from a group consisting of acrylic acid, methacrylic acid, maleic acid, fumaric acid, crotonic acid, itaconic acid, citraconic acid, maleic anhydride, anhydrous citraconic acid, and tetrahydro phthalic anhydride.

* * * * *